US008777565B2

(12) United States Patent
Kondo et al.

(10) Patent No.: US 8,777,565 B2
(45) Date of Patent: Jul. 15, 2014

(54) CASING STRUCTURE OF STEAM TURBINE

(75) Inventors: Makoto Kondo, Takasago (JP); Tamiaki Nakazawa, Minato-ku (JP); Takashi Nakano, Minato-ku (JP); Yasuyuki Tatsumi, Minato-ku (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 867 days.

(21) Appl. No.: 12/918,865

(22) PCT Filed: Mar. 12, 2009

(86) PCT No.: PCT/JP2009/054764

§ 371 (c)(1),
(2), (4) Date: Aug. 23, 2010

(87) PCT Pub. No.: WO2009/122879

PCT Pub. Date: Oct. 8, 2009

(65) Prior Publication Data

US 2011/0020117 A1 Jan. 27, 2011

(30) Foreign Application Priority Data

Mar. 31, 2008 (JP) ..... 2008-093346

(51) Int. Cl.
*F01D 25/26* (2006.01)
*F01D 25/28* (2006.01)

(52) U.S. Cl.
USPC ..... 415/213.1; 415/214.1; 415/220

(58) Field of Classification Search
USPC ..... 415/108, 213.1, 214.1, 220, 226, 232
See application file for complete search history.

(56) References Cited

U.S. PATENT DOCUMENTS

| | | | |
|---|---|---|---|
| 3,520,634 | A | 7/1970 | Bellati et al. |
| 3,808,819 | A | 5/1974 | Engelke et al. |
| 3,881,843 | A | 5/1975 | Meylan |
| 3,942,907 | A | 3/1976 | Meylan |

(Continued)

FOREIGN PATENT DOCUMENTS

| | | |
|---|---|---|
| JP | 48-39804 | 6/1973 |
| JP | 49-81702 | 8/1974 |

(Continued)

OTHER PUBLICATIONS

Japanese Decision of a Patent Grant issued Dec. 18, 2012 in corresponding Japanese Patent Application No. 2008-093346 with English translation.

(Continued)

*Primary Examiner* — Edward Look
*Assistant Examiner* — Jason Davis
(74) *Attorney, Agent, or Firm* — Wenderoth, Lind & Ponack, L.L.P.

(57) ABSTRACT

A steam turbine has an outer casing that is divided into an upper casing and a lower casing (a lower block) on a horizontal plane through which a rotor passes. The upper casing is divided into a middle block having a through hole and an upper block having a top panel, that is, into a portion including at least a part of the through hole through which the rotor penetrates. With this configuration, machining of a bellows fitting unit provided in an end-plate cone portion can be performed in existing facilities such as a factory, in a state that the lower block and the middle block are assembled without assembling the upper block.

3 Claims, 9 Drawing Sheets

(56) References Cited

U.S. PATENT DOCUMENTS

| | | | | |
|---|---|---|---|---|
| 4,102,598 | A * | 7/1978 | Stock et al. | 415/135 |
| 4,744,726 | A | 5/1988 | Remberg | |
| 6,971,842 | B2 * | 12/2005 | Luniewski et al. | 415/100 |

FOREIGN PATENT DOCUMENTS

| | | |
|---|---|---|
| JP | 62-3106 | 1/1987 |
| JP | 2002-235505 | 8/2002 |
| JP | 3831617 | 8/2002 |
| JP | 2005-113721 | 4/2005 |

OTHER PUBLICATIONS

Supplementary European Search Report issued Feb. 22, 2013 in corresponding European Patent Application No. 09728296.6.

International Search Report issued Apr. 14, 2009 in International (PCT) Application No. PCT/JP2009/054764.

* cited by examiner

CASING STRUCTURE OF STEAM TURBINE

TECHNICAL FIELD

The present invention relates to a casing structure of a steam turbine that generates power by rotating a rotor by using steam.

BACKGROUND ART

In a general steam turbine, an inner casing is provided in an outer casing, a steam inlet is provided at an upper part thereof, a rotor is rotatably supported in a central part thereof, and rotor blades are fixed to the rotor in multiple stages. Besides, stator vanes are fixed in multiple stages to a turbine diaphragm ring supported in the inner casing, so that the rotor blades fixed to the rotor and the stator vanes are alternately arranged.

Therefore, when the steam enters the inner casing from the steam inlet at the time of operating the steam turbine, the steam blows out to the rotor blades via a partition wall through the stator vanes supported by the turbine diaphragm ring, to rotate the rotor and drive a power generator connected to the rotor.

The casing (outer casing, inner casing) that constitutes a turbine body of the steam turbine is divided into two parts, that is, upper and lower casings on a plane passing through a rotor, and is assembled by a flange and a bolt to improve the workability in insertion, assembly, and disassembly operations of the rotor. When the steam turbine is a low-pressure turbine, a lower part of the outer casing is connected to a steam condenser, and at the time of activating the steam turbine, the inner casing and the outer casing are evacuated to a vacuum state, thereby sucking the steam from the steam inlet into the casing (see Patent Document 1).

At this time, the outer casing deforms in such a manner that end plates forming a ceiling and walls of the outer casing are largely depressed inward, and thus the ceiling and walls need to be reinforced. As a reinforcing structure of the outer casing in the steam turbine, for example, there is a structure in which a plurality of ribs divided uniformly around a rotor shaft are bonded to the end plates of the outer casing by welding or the like, and a plurality of ribs are bonded to the lower-half end plates of the outer casing crosswise in a lattice-like arrangement by welding or the like. Furthermore, there is a structure in which a pipe stay is built inside an outer casing (see Patent Document 2).

In such a casing structure of such a steam turbine, a plurality of I-shaped ribs are arranged on an upper-half end plates of an outer casing radially around a rotor shaft, and an arrangement angle thereof is gradually increased as the angle changes from vertical to horizontal.

Patent Document 1: Japanese Patent Application Laid-open No. 2005-113721

Patent Document 2: Japanese Patent No. 3831617

SUMMARY OF INVENTION

Problem to be Solved by the Invention

It has been desired to increase the size of steam turbines to increase power generation efficiency of power generators. If the size of the steam turbine becomes larger, the lengths of a rotor blade and a stator vane also increase, and thus it is necessary to increase the size of an outer casing.

In the casing structure of conventional steam turbines; however, axial deviation of a bellows fitting unit, to which a bellows is to be fitted, needs to be finished to a plane by machining in an assembled state. Therefore, when the outer casing becomes large, machining of the bellows fitting unit cannot be performed in a vertically integrated and assembled state.

Further, to assemble a large-sized outer casing in a vertically integrated manner or to hoist an upper part of the outer casing at the time of periodic inspections, the height of its facility needs to be increased. Therefore, there is a problem that the outer casing cannot be assembled in the vertically integrated manner or the upper part of the outer casing cannot be hoisted.

Furthermore, even if the outer casing is assembled in the vertically integrated manner and machining of the bellows fitting unit is performed, the casing cannot be transported from a factory in the vertically integrated and assembled state.

Moreover, because machining is performed in an upright state of the outer casing, machining needs to be performed by a horizontal processing machine, and if a position of the bellows fitting unit is high, the machining accuracy can be hardly maintained.

In addition, a large-sized outer casing cannot be accommodated on a machining table, and thus there is a problem that machining cannot be performed in a transversely mounted state of the outer casing.

The present invention has been achieved in view of the above problems, and an object of the present invention is to provide a casing structure of a steam turbine that enables machining of a bellows fitting unit in existing facilities.

Means for Solving Problem

According to an aspect of the present invention, in a casing structure of a steam turbine in which an outer casing is divided vertically, the outer casing is divided into an upper casing and a lower casing, and either one or both of the divided upper casing and the lower casing are divided into a portion including at least a part of a through hole through which a rotor penetrates and other portions.

Advantageously, in the casing structure of a steam turbine, the outer casing is divided into the upper casing and the lower casing on a horizontal plane through which the rotor passes, and the upper casing is divided into a middle block having the through hole and an upper block having a top panel.

Advantageously, in the casing structure of a steam turbine, the outer casing is divided into the upper casing having a top panel and the lower casing having the through hole, and the lower casing is divided into a middle piece cut out to include an end-plate cone portion from a center of the through hole in a horizontal direction, and a remaining lower block including the end-plate cone portion.

Advantageously, in the casing structure of a steam turbine, the outer casing is divided into the upper casing and the lower casing on a horizontal plane through which the rotor passes, the upper casing is divided into an upper part of an end-plate cone of an end-plate cone portion and an upper block having a top panel, and the lower casing is divided into a lower part of an end-plate cone of the end-plate cone portion and a lower block including other remaining parts.

Advantageously, in the casing structure of a steam turbine, a bonding portion on an outer circumference of the end-plate cone portion is formed in an L shape.

Advantageously, in the casing structure of a steam turbine, a peripheral shape of an external form of the end-plate cone portion is polygonal.

Advantageously, in the casing structure of a steam turbine, the upper block is horizontally divided on a vertical plane from a center of the through hole.

Effect of the Invention

According to a first aspect of the casing structure of a steam turbine of the invention, the outer casing is divided into the upper casing and the lower casing, and either one or both of the divided upper casing and the lower casing are divided into a portion including at least a part of a through hole through which a rotor penetrates and other portions. Accordingly, machining of a bellows fitting unit can be performed in existing facilities such as a factory, in a state that the upper casing is not assembled.

Further, at the time of periodic inspections, the rotor can be replaced by detaching only the upper casing. Because the height of the upper casing becomes lower than conventional upper casings, there is no need to make the height of the facility very high, and thus the upper casing can be disassembled without changing the height of the facility on the spot.

According to a second aspect of the casing structure of a steam turbine of the invention, the outer casing is divided into the upper casing and the lower casing on a horizontal plane through which the rotor passes, and the upper casing is divided into the middle block having the through hole and the upper block having the top panel. Accordingly, machining of the bellows fitting unit provided in the end-plate cone portion can be performed in existing facilities such as a factory, in a state that the lower casing (the lower block) and the middle block are assembled without assembling the upper block.

Further, at the time of periodic inspections, the rotor can be replaced by detaching only the upper block. Because the height of the upper block becomes lower than conventional ones, there is no need to make the height of the facility very high, and thus the upper block can be disassembled without changing the height of the facility on the spot.

According to a third aspect of the casing structure of a steam turbine of the invention, the outer casing is divided into the upper casing having a top panel and the lower casing having the through hole, and the lower casing is divided into the middle piece cut out to include the end-plate cone portion from a center of the through hole in a horizontal direction, and the remaining lower block including the end-plate cone portion. Accordingly, machining of the bellows fitting unit provided in the end-plate cone portion can be performed in existing facilities such as a factory, in a state that the lower block and the middle piece are assembled without including the upper casing (the upper block).

Further, by providing the middle piece, the weight can be reduced, and the number of bolts on a bonding plane between the upper block and the lower block can be decreased, thereby enabling to improve the workability in an assembly operation.

According to a fourth aspect of the casing structure of a steam turbine of the invention, the outer casing is divided into the upper casing and the lower casing on a horizontal plane through which a rotor passes, the upper casing is divided into an upper part of the end-plate cone of the end-plate cone portion and an upper block having the top panel, and the lower casing is divided into a lower part of the end-plate cone of the end-plate cone portion and a lower block including other remaining parts. Therefore, machining of a bellows fitting plane including the bellows fitting unit can be performed in existing facilities such as a factory, by bonding the upper part and the lower part of the end-plate cone and transversely mounting only the end-plate cone portion. Accordingly, machining of the bellows fitting plane can be performed in existing facilities such as a factory, and the machining accuracy can be improved.

According to a fifth aspect of the casing structure of a steam turbine of the invention, the bonding portion on an outer circumference of the end-plate cone portion is formed in an L shape. Therefore, a joint portion in the bonding portion between the end-plate cone portion and the outer casing has an L shape, and the bonding portion is formed to form a longitudinal joint with the outer casing. Accordingly, a plane joint becomes possible and a joint surface of the bolt can be made planar, thereby enabling to improve the sealing performance.

According to a sixth aspect of the casing structure of a steam turbine of the invention, because the peripheral shape of the external form of the end-plate cone portion is polygonal, the joint surface of the bolt can be made planar, thereby enabling to improve the sealing performance.

According to a seventh aspect of the casing structure of a steam turbine of the invention, because the upper block is horizontally divided on a vertical plane from a center of the through hole, the height of the upper block becomes further lower than conventional ones, and the upper casing can be divided only by horizontally shifting the disassembled upper casing directly. Accordingly, there is no need to make the height of the facility very high, and thus the upper block can be disassembled without changing the height of the facility on the spot.

EXPLANATIONS OF LETTERS OR NUMERALS

Figure 1:
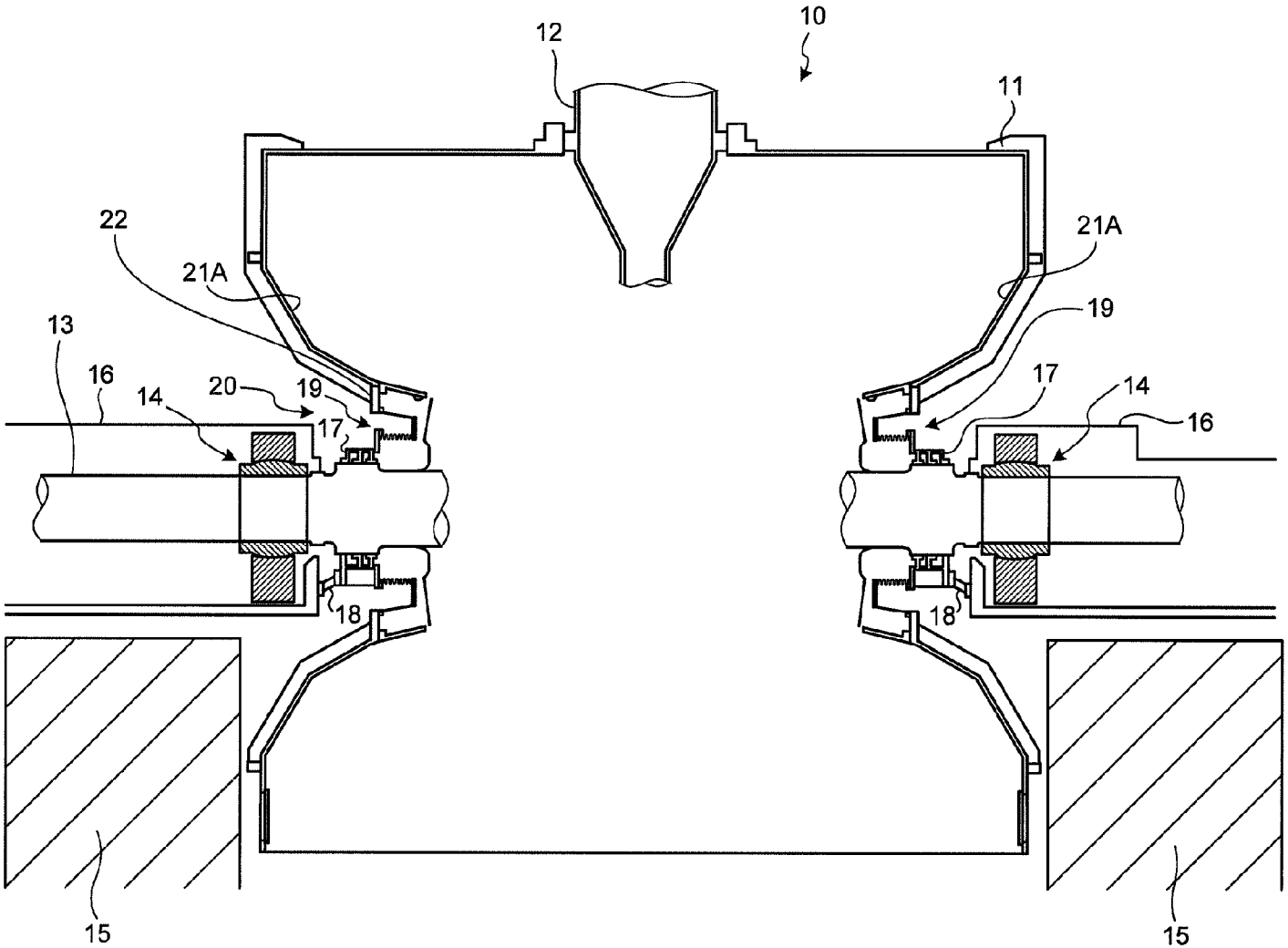
FIG. 1 is a schematic configuration diagram of a steam turbine, to which a casing structure of a steam turbine according to a first embodiment of the present invention is applied.

10 steam turbine
11 outer casing
12 steam inlet
13 turbine rotor (rotor)
14 bearing
15 foundation
16 bearing stand
17 gland portion
18 connecting unit
19 bellows
20 through hole
21*a* joint portion
21A, 21B end-plate cone portion
21A-1, 21B-1 upper part of end-plate cone
21A-2, 21B-2 lower part of end-plate cone
22 bellows fitting unit
31, 41, 51 upper casing
31*a*, 41*a*, 51*a*, 61*a* top panel
31*b* end plate
31*c* flange
32, 42, 52 lower casing
44, 54 lower block
32*a* end plate
32*b* flange
33 middle block
34, 53 upper block
35 first division surface
36 second division surface
43 middle piece
45 third division surface
53*a*, 54*a*, 63*a*, 64*a* joint portion
55, 65 outer circumference
56, 66 bonding portion
57, 67 bolt
68 fourth division surface

DETAILED DESCRIPTION OF THE INVENTION

Exemplary embodiments of a seal member according to the present invention will be explained below in detail with reference to the accompanying drawings. The invention is not limited to the embodiments. In addition, constituent elements in the following embodiments include those that can be easily assumed by those skilled in the art or that are substantially equivalent.

First Embodiment

Figure 2:
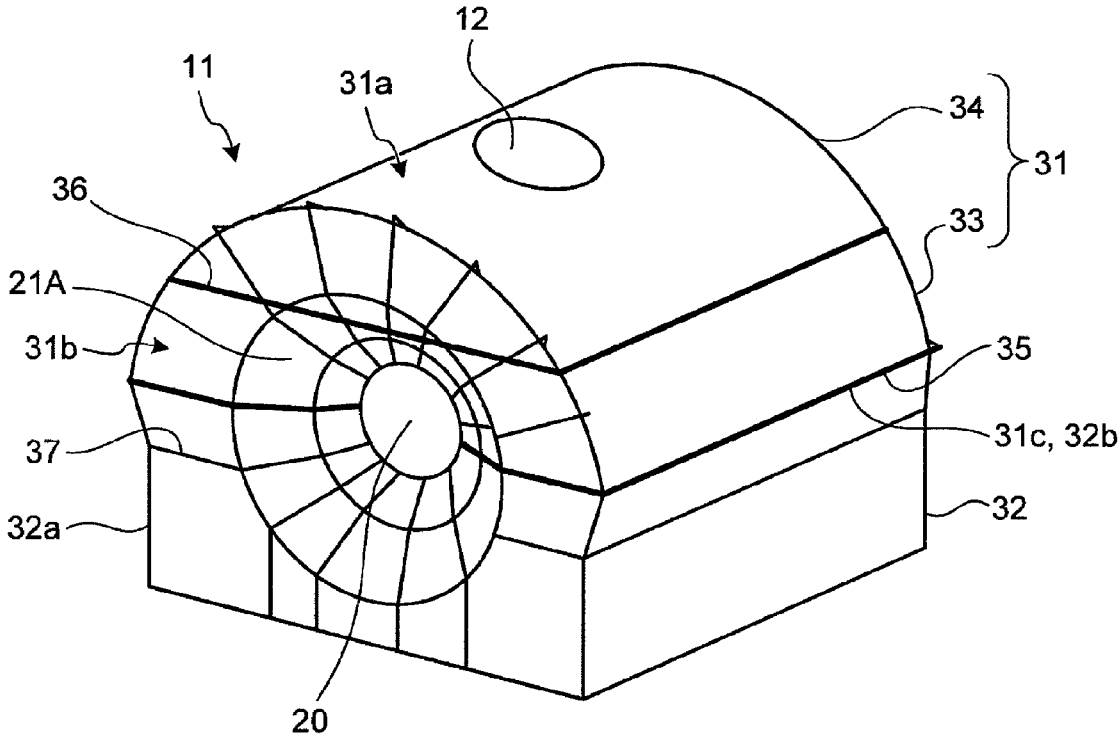
FIG. 2 is a perspective view of an outer casing, representing the casing structure of a steam turbine according to the first embodiment.
Figure 3:
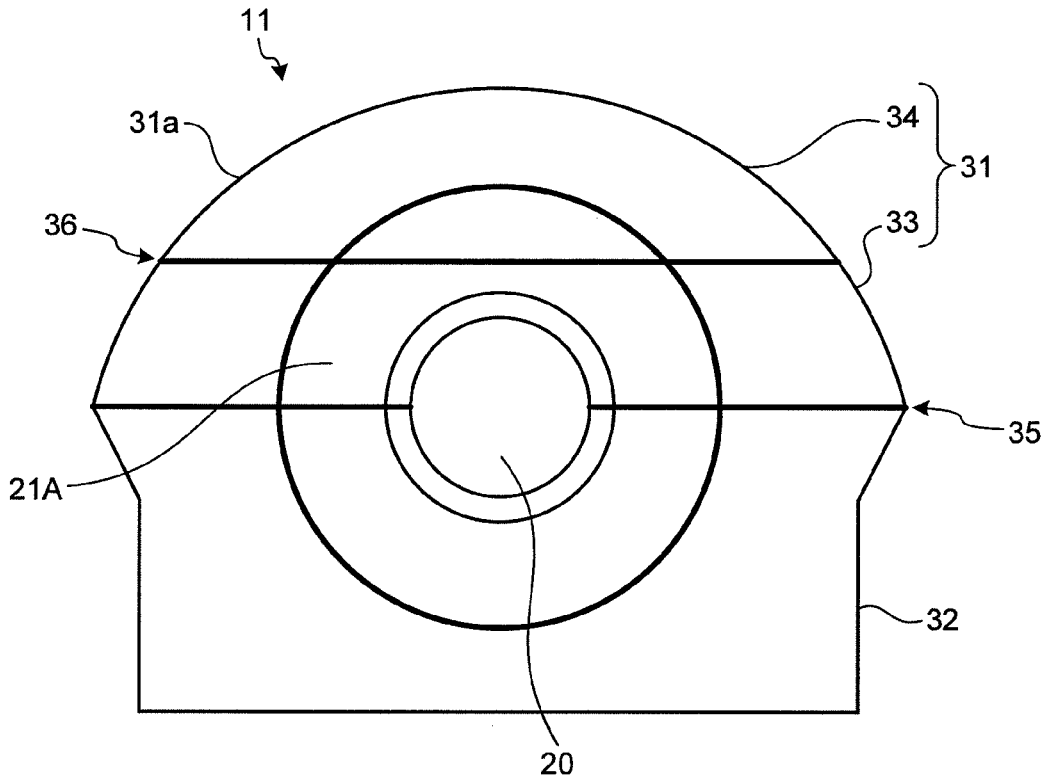
FIG. 3 is a sectional view of the outer casing, representing the casing structure of a steam turbine according to the first embodiment of the present invention, as viewed from a vertical direction with respect to an axial direction.

FIG. 1 is a schematic configuration diagram of a steam turbine, to which a casing structure of a steam turbine according to a first embodiment of the present invention is applied. FIG. 2 is a perspective view of an outer casing, representing the casing structure of a steam turbine according to the first embodiment of the present invention. FIG. 3 is a sectional view of the outer casing, representing the casing structure of a steam turbine according to the first embodiment of the present invention, as viewed from a vertical direction with respect to an axial direction.

As shown in FIG. 1, a steam turbine 10 according to the first embodiment is provided with a steam inlet 12 at an upper part of an outer casing 11, a turbine rotor (hereinafter, "rotor") 13 as a rotation body is supported by a bearing 14, which rotatably supports the rotor 13, and the bearing 14 is supported by a bearing stand 16 provided on a foundation 15 formed of concrete or the like of the steam turbine 10. Further, a gland portion 17 is supported by the bearing stand 16 and a connecting unit 18 thereof. A bellows 19 that prevents leakage of steam is used between the gland portion 17 and the casing 11.

The bellows 19 is fitted to a machining surface of a bellows fitting unit 22 of an end-plate cone portion 21A of the outer casing 11 by a bolt through a through hole 20 through which the rotor 13 of the outer casing 11 penetrates.

In the present embodiment, the outer casing 11 is divided into an upper casing and a lower casing, and is further divided into a portion including at least a part of the through hole 20 through which the rotor 13 penetrates, and other portions.

That is, as shown in FIGS. 2 and 3, the outer casing 11 is divided into an upper casing 31 and a lower casing (a lower block) 32 on a horizontal plane through which the rotor 13 passes, and the upper casing 31 is divided into a middle block 33 having the through hole 20 and an upper block 34 having a top panel 31*a*.

In the present embodiment, the outer casing 11 is divided into the upper casing 31 and the lower block chamber 32 by a first division surface 35 on the horizontal plane through which the rotor 13 passes. The upper casing 31 is divided into the middle block 33 having the through hole 20 and the upper block 34 having the top panel 31*a* by a second division surface 36.

The upper casing 31 includes the top panel 31*a* having a curved shape and front and back end plates 31*b*, and a flange 31*c* is formed integrally therewith at a lower part thereof.

The lower casing 32 includes front and back and right and left end plates 32*a*, and a flange 32*b* is formed integrally therewith at an upper part thereof.

In the upper casing 31 and the lower casing 32, respective flanges 31*c* and 32*b* are connected to each other by fastening bolts (not shown), and a lower end of the lower casing 32 is fitted to a base (not shown) and connected to a steam condenser (not shown).

Further, a plurality of reinforcing ribs 37 are radially arranged around the through hole 20 on the end plate 31*b* of the upper casing 31 of the outer casing 11.

The upper block 34, the middle block 33, and the lower block 32 are divided respectively. For example, the upper block 34, the middle block 33, and the lower block 32 are respectively divided into three. The number of division of the respective blocks is not particularly limited to three.

Therefore, according to the casing structure of a steam turbine of the first embodiment, the outer casing 11 is divided into the upper casing 31 and the lower casing 32 on the horizontal plane through which the rotor 13 passes, and the upper casing 31 is divided into the middle block 33 having the through hole 20 and the upper block 34 having the top panel 31*a*. Therefore, machining of the bellows fitting unit 22 provided in the end-plate cone portion 21A can be performed in existing facilities such as a factory, in a state that the lower casing 32 and the middle block 33 are assembled without assembling the upper casing 34.

Further, at the time of periodic inspections, the rotor 13 can be replaced by detaching only the upper casing 34. Because the height of the upper casing 34 becomes lower than conventional ones, there is no need to make the height of the facility very high, and thus the upper casing 34 can be disassembled without changing the conventional height of the facility on the spot.

Second Embodiment

Figure 4:
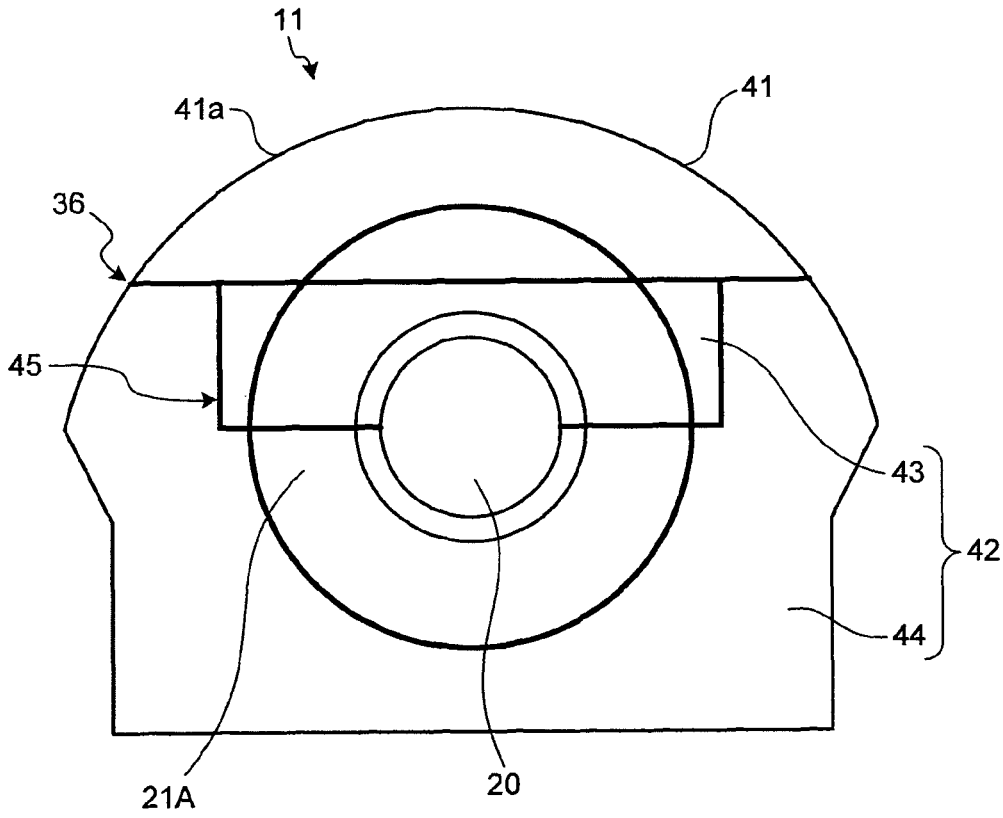
FIG. 4 is a sectional view of an outer casing, representing a casing structure of a steam turbine according to a second embodiment of the present invention, as viewed from a vertical direction with respect to an axial direction.

FIG. 4 is a sectional view of an outer casing, representing a casing structure of a steam turbine according to a second embodiment of the present invention, as viewed from a vertical direction with respect to an axial direction.

Elements having like functions to those explained in the above embodiment are denoted by like reference letters or numerals and explanations thereof will be omitted. Further, explanations of the entire steam turbine will be omitted and only the structure of the outer casing is explained.

In the casing structure of a steam turbine according to the present embodiment, as shown in FIG. 4, the outer casing 11 is divided into an upper casing (an upper block) 41 having the top panel 41*a* and a lower casing 42 having the through hole 20, and the lower casing 42 is divided into a middle piece 43 cut out to include the end-plate cone portion 21A from a center of the through hole 20 in a horizontal direction, and a remaining lower block 44 including the end-plate cone portion 21A. Reference character 41*a* denotes a top panel of the upper casing 41.

In the present embodiment, the outer casing 11 is divided into the upper casing 41 and the lower casing 42 by the second division surface 36 on the horizontal plane through which the rotor 13 passes. The lower casing 42 is divided into the middle piece 43 cut out to include the end-plate cone portion 21A from the center of the through hole 20 in the horizontal direction, and the remaining lower block 44 including the end-plate cone portion 21A by a third division surface 45.

The upper block 41 and the middle piece 43 are divided respectively. For example, the upper block 41 is divided into three, and the middle piece 43 is divided into four. The number of division of the upper block 41 and the middle piece 43 is not particularly limited thereto.

Accordingly, machining of the bellows fitting unit 22 provided in the end-plate cone portion 21A can be performed in existing facilities such as a factory, in a state that the lower block 44 and the middle piece 43 are assembled without including the upper block 41.

Further, by providing the middle piece 43, the weight thereof can be reduced as compared to a case that the middle block 33 is used as in the first embodiment, and the number of bolts on a bonding plane between the upper block 41 and the lower block 44 can be decreased, thereby enabling to improve the workability in an assembly operation.

Third Embodiment

Figure 5:
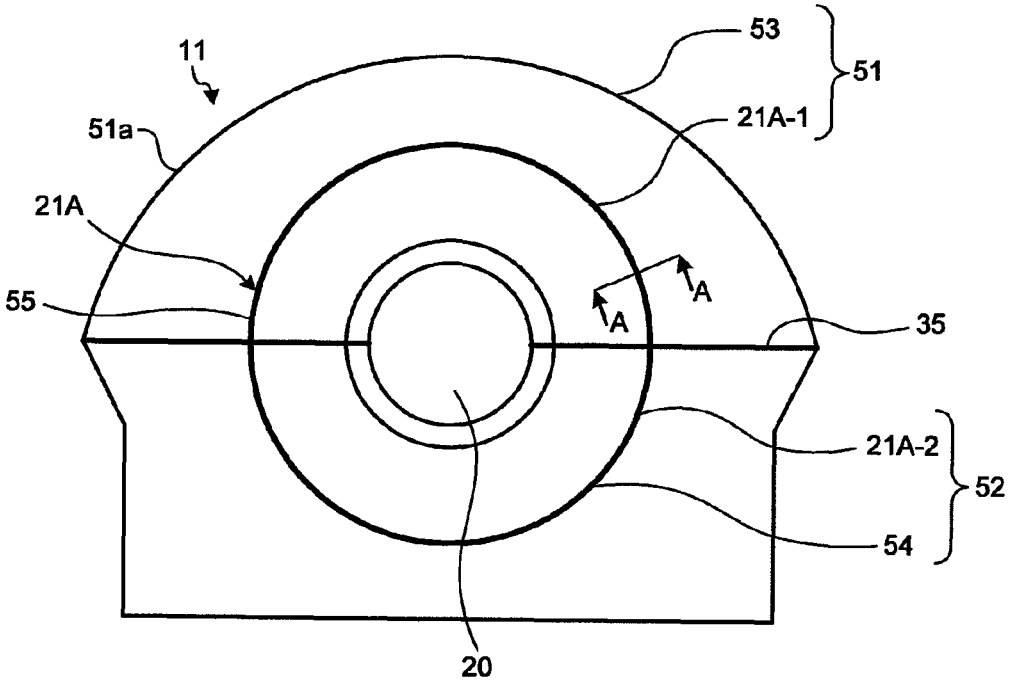
FIG. 5 is a sectional view of an outer casing, representing a casing structure of a steam turbine according to a third embodiment of the present invention, as viewed from a vertical direction with respect to an axial direction.
Figure 6:
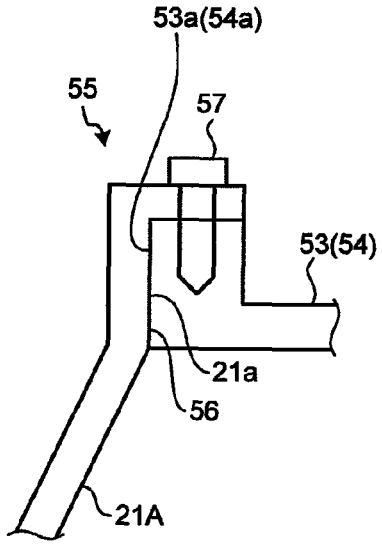
FIG. 6 is a sectional view along a line A-A in FIG. 5.

FIG. 5 is a sectional view of an outer casing, representing a casing structure of a steam turbine according to a third embodiment of the present invention, as viewed from a vertical direction with respect to an axial direction. FIG. 6 is a sectional view along a line A-A in FIG. 5.

Elements having like functions to those explained in the above embodiments are denoted by like reference letters or numerals and explanations thereof will be omitted. Further, explanations of the entire steam turbine will be omitted and only the structure of the outer casing is explained.

In the casing structure of a steam turbine according to the third embodiment, the end-plate cone portion 21A is further divided by the first division surface 35, which divides the outer casing 11 into an upper casing 51 and a lower casing 52 on a horizontal plane through which the rotor 13 passes.

That is, in the casing structure of a steam turbine according to the third embodiment, as shown in FIG. 5, the outer casing 11 is divided into the upper casing 51 and the lower casing 52 on the horizontal plane through which the rotor 13 passes. The upper casing 51 is further divided into an upper block 53 having an upper part 21A-1 of an end-plate cone of the end-plate cone portion 21A and the top panel 31*a*, and the lower casing 52 is divided into a lower part 21A-2 of the end-plate cone of the end-plate cone portion 21A and a lower block 54 including other remaining parts. Reference character 51*a* denotes a top panel of the upper casing 51.

Therefore, because machining of the bellows fitting unit 22 can be performed in existing facilities such as a factory, with only the end-plate cone portion 21A being transversely mounted, machining of the bellows fitting unit 22 can be performed in existing facilities such as a factory and the machining accuracy can be improved.

As shown in FIG. 6, in the end-plate cone portion 21A, a bonding portion 56 of an outer circumference 55 is formed in an L shape. That is, in the bonding portion 56 between the end-plate cone portion 21A and the upper block 53 (the lower block 54) of the outer casing 11, a joint portion 21*a* of the end-plate cone portion 21A is formed in an L shape, so that it forms a longitudinal joint with a joint portion 53*a* (54*a*) of the upper block 53 (the lower block 54).

By forming the bonding portion 56 of the outer circumference 55 of the end-plate cone portion 21A in an L shape, an end of the joint portion 21*a* of the end-plate cone portion 21A and the joint portion 53*a* (54*a*) of the upper block 53 (the lower block 54) are flatly bonded. Therefore, a plane joint can be formed between the joint portion 21*a* of the end-plate cone portion 21A and the joint portion 53*a* (54*a*) of the upper block 53 (the lower block 54), and a joint surface of a bolt 57 can be made planar, thereby enabling to improve the sealing performance.

Fourth Embodiment

Figure 7:
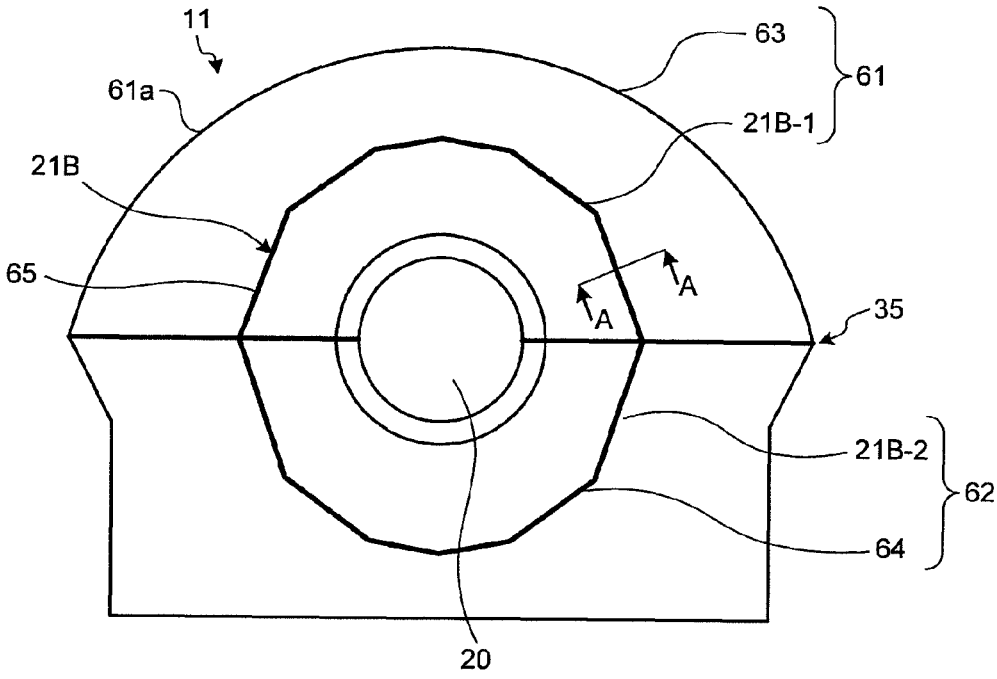
FIG. 7 is a sectional view of an outer casing, representing a casing structure of a steam turbine according to a fourth embodiment of the present invention, as viewed from a vertical direction with respect to an axial direction.
Figure 8:
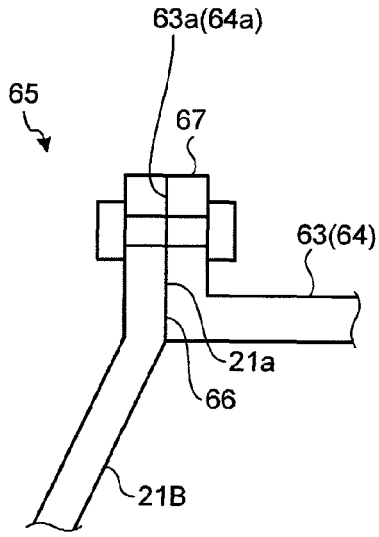
FIG. 8 is a sectional view along a line A-A in FIG. 7.

FIG. 7 is a sectional view of an outer casing, representing a casing structure of a steam turbine according to a fourth embodiment of the present invention, as viewed from a vertical direction with respect to an axial direction. FIG. 8 is a sectional view along a line A-A in FIG. 7.

Elements having like functions to those explained in the above embodiments are denoted by like reference letters or numerals and explanations thereof will be omitted. Further, explanations of the entire steam turbine will be omitted and only the structure of the outer casing is explained.

In the casing structure of a steam turbine according to the fourth embodiment, an end-plate cone portion 21B is used in which the peripheral shape of the external form of the end-plate cone portion 21A in the casing structure of a steam turbine according to the third embodiment is made polygonal. While the external shape of the end-plate cone portion is hendecagon in the present embodiment, the present invention is not limited thereto.

That is, in the casing structure of a steam turbine according to the fourth embodiment, as shown in FIG. 7, the outer casing 11 is divided into an upper casing 61 and a lower casing 62 on a horizontal plane through which the rotor 13 passes. Further, the upper casing 61 is divided into an upper block 63 having an upper part 21B-1 of an end-plate cone of the end-plate cone portion 21B and the top panel 31*a*, and the lower casing 62 is divided into a lower part 21B-2 of the end-plate cone of the end-plate cone portion 21B and a lower block 64 including other remaining parts. Reference character 61*a* denotes a top panel of the upper casing 61.

By making the peripheral shape of the external shape of the end-plate cone portion 21B polygonal, as shown in FIG. 8, a joint surface of the bolt in a bonding portion 66 between a peripheral part 65 of the end-plate cone portion 21B and the upper block 63 (the lower block 64) can be made planar. That is, in the bonding portion 66 between the end-plate cone portion 21B and the upper block 63 (the lower block 64), the joint portion 21*a* of the end-plate cone portion 21B and a joint portion 63*a* (64*a*) of the upper block 63 (the lower block 64) can be flatly bonded.

Accordingly, by making the peripheral shape of the external shape polygonal as in the end-plate cone portion 21B, the joint portion 21*a* of the end-plate cone portion 21B and the joint portion 63*a* (64*a*) of the upper block 63 (the lower block 64) is flatly bonded, and the joint surface of the bolt can be made planar, thereby enabling to improve the sealing performance.

Fifth Embodiment

Figure 9:
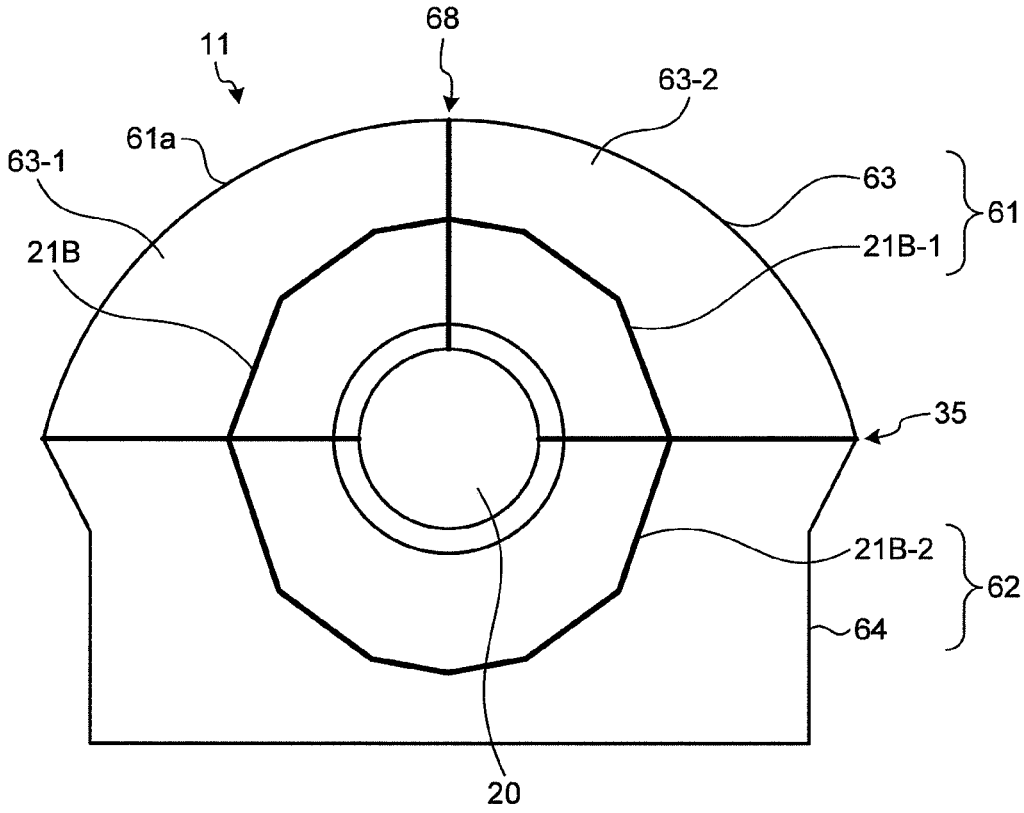
FIG. 9 is a sectional view of an outer casing, representing a casing structure of a steam turbine according to a fifth embodiment of the present invention, as viewed from a vertical direction with respect to an axial direction.
Figure 10:
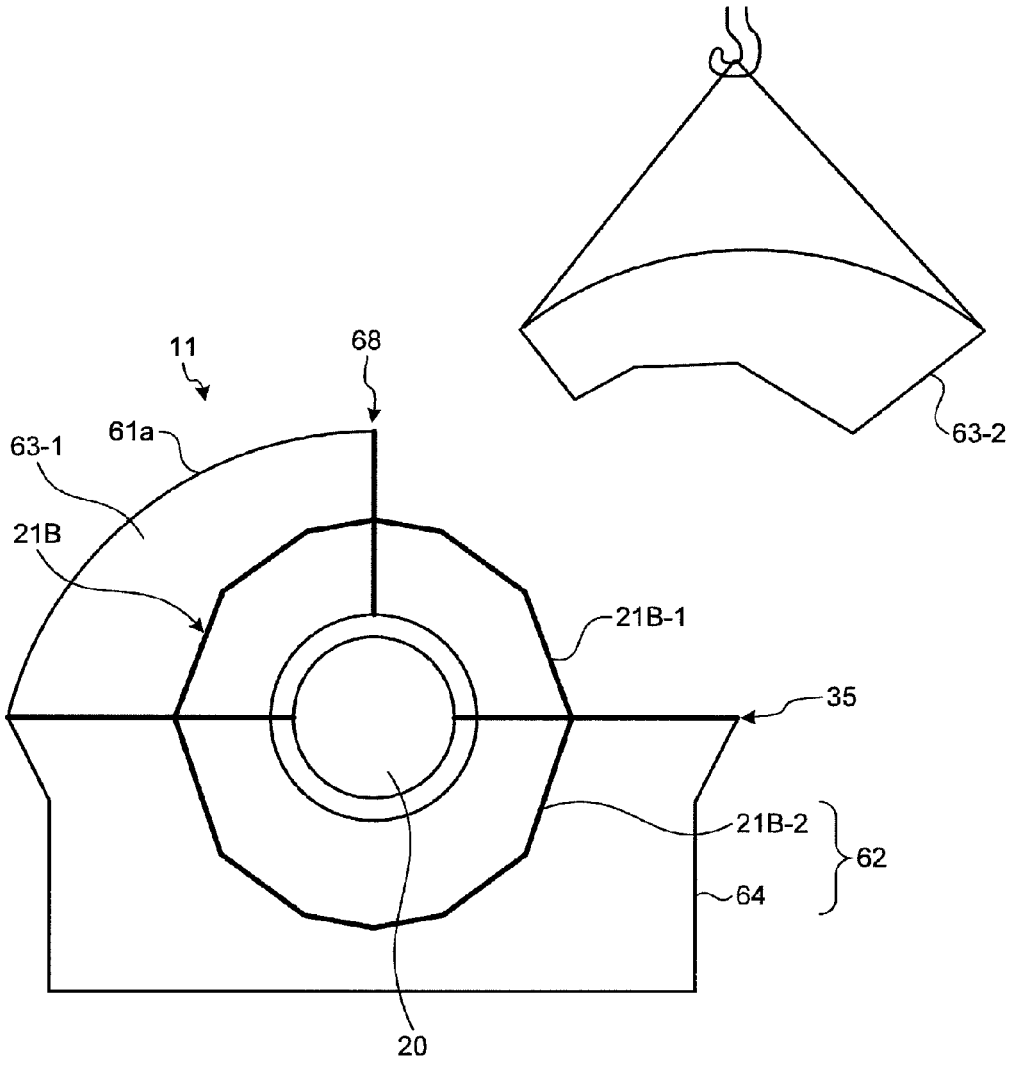
FIG. 10 is an exploded view of a part of an upper block.

FIG. 9 is a sectional view of an outer casing, representing a casing structure of a steam turbine according to a fifth embodiment of the present invention, as viewed from a vertical direction with respect to an axial direction, in which an upper block is assembled. FIG. 10 is an exploded view of a part of the upper block.

Elements having like functions to those explained in the above embodiments are denoted by like reference letters or numerals and explanations thereof will be omitted. Further, explanations of the entire steam turbine will be omitted and only the structure of the outer casing is explained.

In the casing structure of a steam turbine according to the fifth embodiment, the upper block is horizontally divided into two upper blocks on a vertical plane from a center of a through hole.

That is, as shown in FIGS. 9 and 10, the upper block 63 is horizontally divided into upper blocks 63-1 and 63-2 on the vertical plane from the center of the through hole 20.

In the present embodiment, the upper block 63 is divided into the upper blocks 63-1 and 63-2 by a fourth division surface 68 on the vertical plane through which the rotor 13 passes.

Therefore, by horizontally disassembling the upper block 63, the height of the upper block 63 becomes further lower than conventional ones, and the upper block can be divided into the upper blocks 63-1 and 63-2 only by horizontally shifting the disassembled upper blocks 63-1 and 63-2. Accordingly, there is no need to make the height of the facility very high, and the upper blocks 63-1 and 63-2 can be disassembled without changing the height of the facility on the spot.

Figure 11:
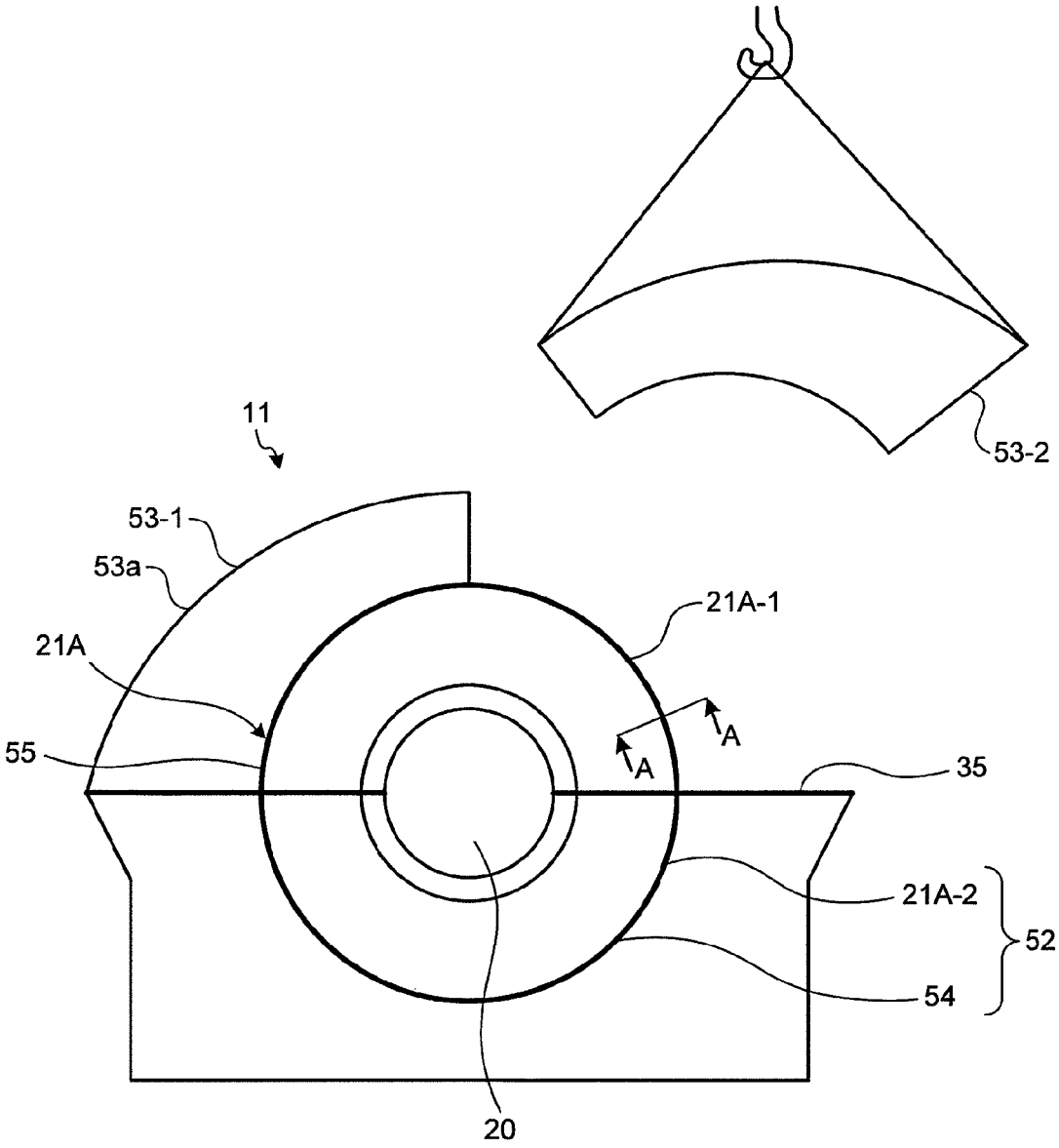
FIG. 11 is a sectional view of the outer casing, representing another structure of the casing structure of a steam turbine according to the fifth embodiment of the present invention, as viewed from a vertical direction with respect to an axial direction.

The present invention is not limited thereto and, as shown in FIG. 11, even when the outer casing 11 having the end-plate cone portion 21A as shown in FIG. 5 is used, the upper block 51 can be horizontally divided on a vertical plane from the center of the through hole 20 to be disassembled into the upper blocks 53-1 and 53-2.

INDUSTRIAL APPLICABILITY

The casing structure of a steam turbine of the present invention easily performs disassembly and transport of a casing and performs machining of a bellows fitting unit in existing facilities, and the casing structure can be applied to any type of steam turbines.

The invention claimed is:

1. A casing structure for a steam turbine, the casing structure comprising:

an outer casing divided horizontally into an upper casing and a lower casing, wherein at least one of the upper casing and the lower casing is divided into at least two parts, one of the two parts being a portion including at least part of a through hole through which a rotor penetrates, the outer casing is divided into the upper casing and the lower casing on a horizontal plane through which the rotor passes, the upper casing is divided into an upper part of an end-plate cone of an end-plate cone portion and an upper block having a top panel, the lower casing is divided into a lower part of an end-plate cone of the end-plate cone portion and a lower block, and a bonding portion on an outer circumference of the end-plate cone portion is formed in an L shape.

2. The casing structure of a steam turbine according to claim 1, wherein a peripheral shape of an external form of the end-plate cone portion is polygonal.

3. The casing structure of a steam turbine according to claim 1, wherein the upper block is divided on a vertical plane that passes through a center of the through hole.

* * * * *